US009955764B2

(12) United States Patent
Yoshigai

(10) Patent No.: US 9,955,764 B2
(45) Date of Patent: May 1, 2018

(54) DRAWING DEVICE AND METHOD OF DRAWING

(71) Applicant: CASIO COMPUTER CO., LTD., Tokyo (JP)

(72) Inventor: Akio Yoshigai, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days. days.

(21) Appl. No.: 15/380,973

(22) Filed: Dec. 15, 2016

(65) Prior Publication Data

US 2017/0181522 A1 Jun. 29, 2017

(30) Foreign Application Priority Data

Dec. 25, 2015 (JP) ..... 2015-252906

(51) Int. Cl.

| | |
|---|---|
| ***G06K 15/22*** | (2006.01) |
| ***A45D 29/22*** | (2006.01) |
| ***A45D 34/04*** | (2006.01) |
| ***A45D 29/00*** | (2006.01) |

(52) U.S. Cl.

CPC ..... *A45D 29/22* (2013.01); *A45D 29/00* (2013.01); *A45D 34/04* (2013.01); *A45D 2029/005* (2013.01)

(58) Field of Classification Search

None

See application file for complete search history.

(56) References Cited

U.S. PATENT DOCUMENTS

| | | | | |
|---|---|---|---|---|
| 6,067,996 | A * | 5/2000 | Weber | A45D 34/04 132/200 |
| 6,286,517 | B1 * | 9/2001 | Weber | A45D 29/00 132/200 |
| 6,525,724 | B1 * | 2/2003 | Takami | A45D 29/00 345/418 |
| 8,757,171 | B2 * | 6/2014 | Goff | A45D 29/00 101/35 |
| 2012/0147113 | A1 * | 6/2012 | Yamasaki | A45D 29/00 347/104 |
| 2013/0242019 | A1 * | 9/2013 | Bitoh | A45D 29/00 347/104 |
| 2014/0267517 | A1 * | 9/2014 | Yamasaki | B41J 3/4073 347/101 |

FOREIGN PATENT DOCUMENTS

| | | |
|---|---|---|
| JP | 2000-194838 A | 7/2000 |
| JP | 2012-152410 A | 8/2012 |
| JP | 2013-188348 A | 9/2013 |
| JP | 2014-176441 A | 9/2014 |

* cited by examiner

*Primary Examiner* — Ted Barnes
(74) *Attorney, Agent, or Firm* — Chen Yoshimura LLP

(57) ABSTRACT

A drawing device includes: a finger holding case including a plurality of walls (a bottom wall, left and right sidewalls, a rear wall, and a top wall) surrounding a finger insertion opening into which a finger having a nail to be drawn on is inserted as well as an opening exposing the nail and a finger presser to which a fluid is supplied in order prevent movement of the finger by applying pressure between the finger and the finger holding case and from which the fluid is discharged to stop applying pressure. When the finger presser is not preventing movement of the finger, one of the walls (the top wall or the bottom wall) of the finger holding case moves in order to expand a space between the finger holding case and the finger.

18 Claims, 5 Drawing Sheets

DRAWING DEVICE AND METHOD OF DRAWING

BACKGROUND OF THE INVENTION

Technical Field

The present invention relates to a drawing device and a method of drawing.

Background Art

Various conventional drawing devices for drawing nail designs on fingernails have been proposed. For example, Japanese Patent Application Laid-Open Publication No. 2000-194838 discloses a drawing device that has a finger insertion opening into which a finger can be inserted and that uses an inkjet printing technology to draw a nail design on the nail of the finger inserted into the finger insertion opening.

However, in this type of drawing device that draws a nail design on the nail of a finger inserted into the finger insertion opening, when the finger is removed from the finger insertion opening after drawing is complete, the nail can potentially contact the inner surfaces of the finger insertion opening and damage the nail design drawn on the nail.

Consider in particular a drawing device in which, in order to prevent movement of the finger during drawing, a pressing force is applied by a finger presser to the bottom side of the finger inserted into the finger insertion opening to press the finger upwards such that the portions of the top side of the finger other than the nail are pressed into the upper wall of the finger insertion opening.

Here, although the finger ceases to be pressed upward by the finger presser after drawing is complete, there is still only a small space between the top side of the finger and the upper wall of the finger insertion opening. Therefore, when the finger is removed from the finger insertion opening, the nail is prone to contacting the inner surface of the upper wall of the finger insertion opening.

The present invention was made in light of the foregoing and aims to provide a drawing device and a method of drawing that make it possible to reduce the possibility of the nail coming into contact with the inner surfaces of the finger insertion opening when the finger is removed from the finger insertion opening after drawing is complete. Accordingly, the present invention is directed to a scheme that substantially obviates one or more of the problems due to limitations and disadvantages of the related art.

SUMMARY OF THE INVENTION

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides a drawing device, including: a holding case including a plurality of walls defining an insertion opening into which at least one finger or toe having a nail to be drawn on is inserted, the holding case having another opening that is configured to expose the nail when the at least one finger or toe is fully inserted into the holding case; and a presser that applies pressure between the holding case and the finger or toe by receiving a fluid and that stops applying pressure to the finger or toe by discharging the fluid, wherein, when the presser is not applying pressure to the finger or toe, at least one of the walls of the holding case is configured to move so as to expand a space between the holding case and the finger or toe.

In another aspect, the present disclosure provides a method of drawing for use in a drawing device that includes: a drawing unit that draws on a nail to be drawn on; a holding case including a plurality of walls defining an insertion opening into which at least one finger or toe having the nail to be drawn on is inserted, the holding case having another opening that is configured to expose the nail when the at least one finger or toe is fully inserted into the holding case; and a presser that applies pressure between the holding case and the finger or toe by receiving a fluid and that stops applying pressure to the finger or toe by discharging the fluid, wherein, when the presser is not applying pressure to the finger or toe, at least one of the walls of the holding case is configured to move so as to expand a space between the holding case and the finger or toe, the method including: discharging the fluid from the presser, thereby expanding the space between the holding case and the finger or toe so as to facilitate insertion and removal of the finger or toe into or from the holding case of the drawing device through the insertion opening; receiving the fluid by the presser, thereby applying the pressure between the holding case and the finger or toe so as to fix the finger or toe at an inserted position in the holding case; and drawing on the nail using the drawing unit while the pressure is being applied between the holding case and the finger or toe and the finger or toe is fixed at the inserted position.

The present invention makes it possible to provide a drawing device and a method of drawing that make it possible to reduce the possibility of the nail coming into contact with the inner surfaces of the finger insertion opening when the finger is removed from the finger insertion opening after drawing is complete.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

FIG. 2A is a plan view of the finger holding case. FIG. 2B is a side view of the finger holding case. FIG. 2C is a front view of the finger holding case.

FIG. 3A illustrates a state in which movement of a finger is not restricted, and FIG. 3B illustrates a state in which movement of the finger is restricted.

FIG. 4A illustrates a state in which movement of the finger is not restricted, and FIG. 4B illustrates a state in which movement of the finger is restricted.

DETAILED DESCRIPTION OF EMBODIMENTS

Figure 1:
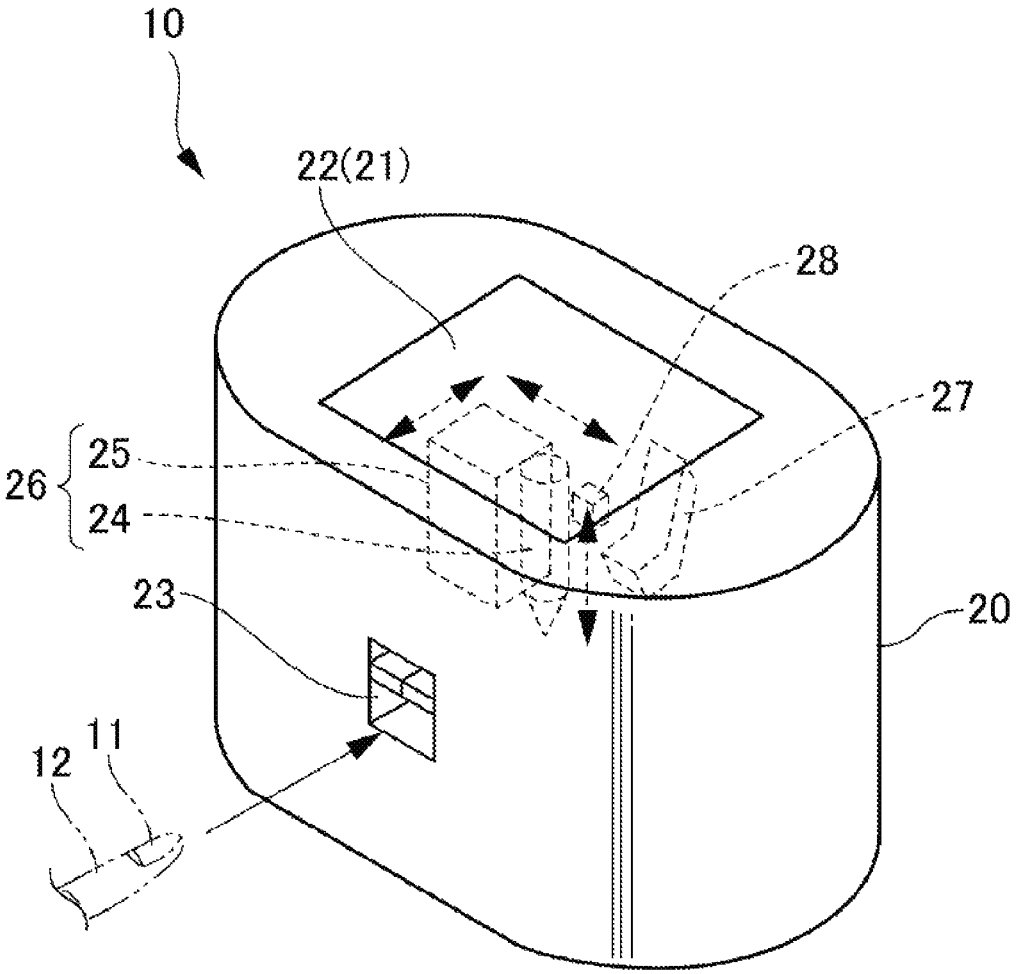
FIG. 1 is a perspective view illustrating the exterior of a drawing device according to an embodiment of the present invention.

Next, an embodiment of the present invention (hereinafter, "the embodiment") will be described in detail with reference to the attached figures. Note that the same reference characters will be used for the same components throughout the entire description of the embodiment.

Moreover, the following description of the embodiment assumes that the drawing device is used to draw on the fingernails. However, the present invention is not limited to this use case and may also be used to draw on the toenails, for example.

(Overall Configuration of Embodiment)

Next, the overall configuration of the drawing device will be described with reference to FIG. 1. FIG. 1 schematically illustrates the exterior of the drawing device.

As illustrated in FIG. 1, a drawing device 10 is a device for drawing a nail design on a nail 11 of a finger 12, for example. The drawing device 10 includes a case 20 and a touch panel-type display unit 22 that also functions as an operation unit 21 and that is provided on the top surface of the case 20. Furthermore, a finger insertion opening 23 is formed in the front surface of the case 20. Inside the case 20, a drawing unit 26 that includes a drawing head 24 and an inkjet 25, a dryer 27 that blows warm air to dry the ink applied to the nail 11, and a camera 28 for recognizing the position and shape of the nail 11 are arranged.

Moreover, the drawing head 24, the inkjet 25, the dryer 27, and the camera 28 can be moved forward and backwards, left and right, and up and down as necessary by various movement units (that is, in the directions indicated by the dashed arrows in FIG. 1).

(Configuration of Finger Holding Case and Surrounding Areas)

Next, the configuration of a finger holding case and the surrounding areas will be described with reference to FIGS. 2A to 4B.

Figure 2A:
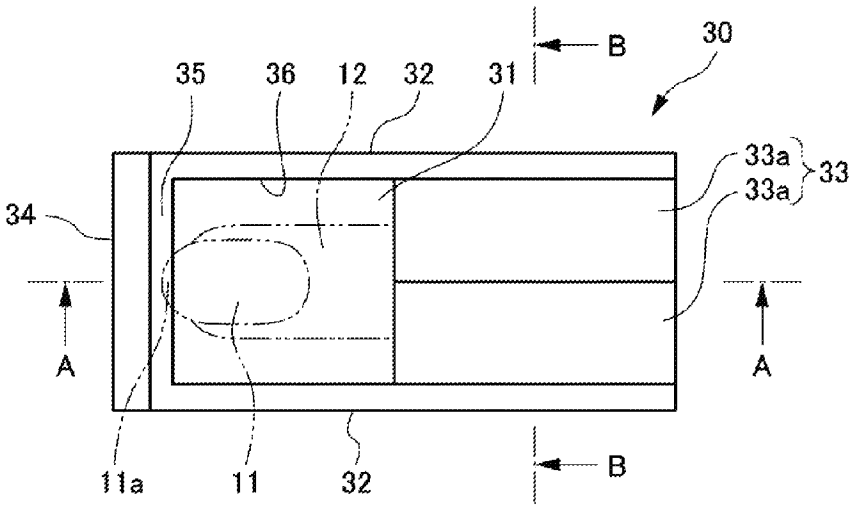
FIGS. 2A to 2C illustrate a finger holding case according to the embodiment.
Figure 2B:
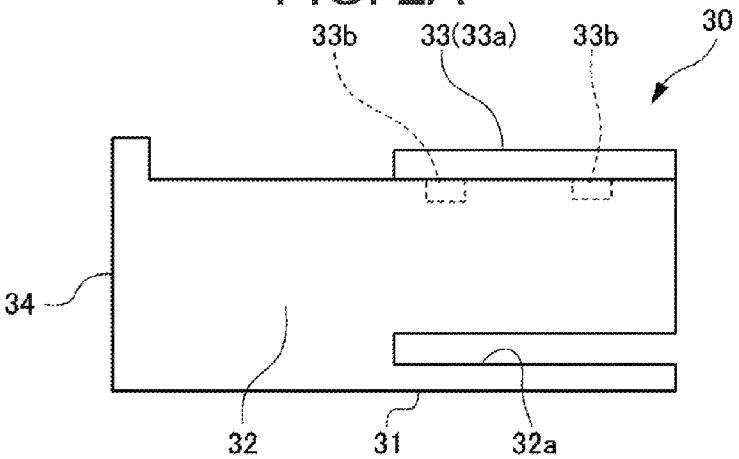
Figure 2C:
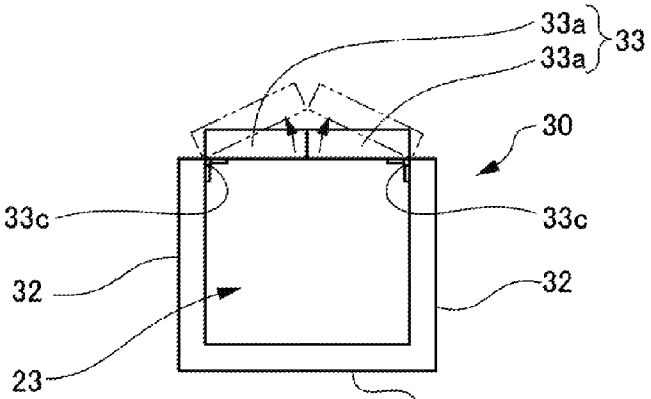
Figure 3A:
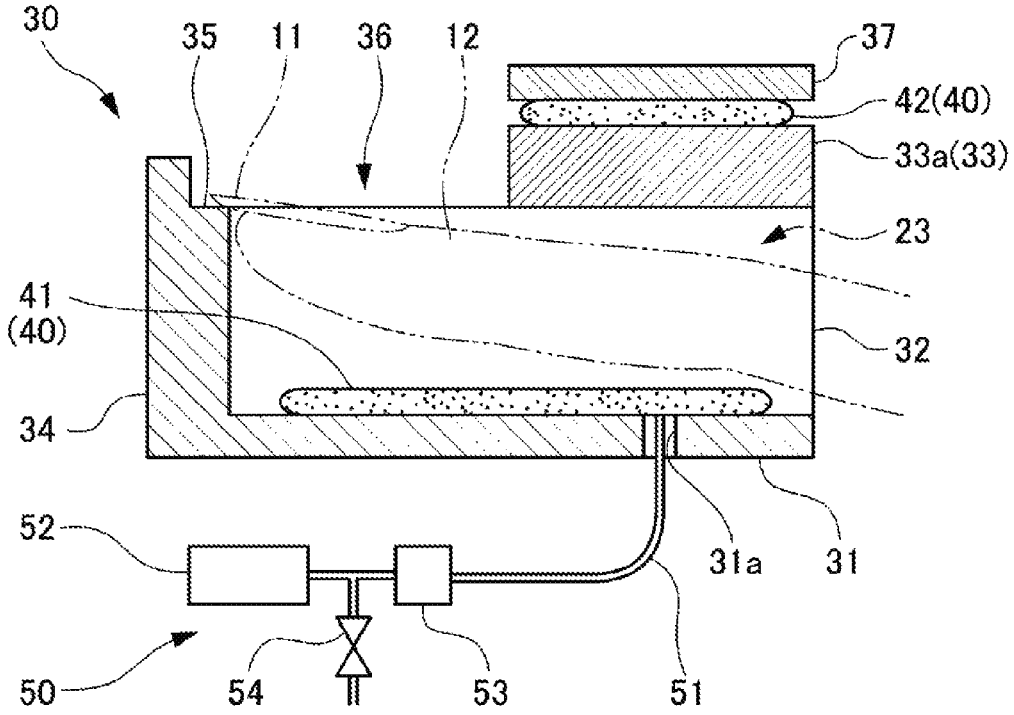
FIGS. 3A and 3B illustrate a cross section of the finger holding case and the surrounding areas according to the embodiment as taken along line A-A in FIG. 2A.
Figure 3B:
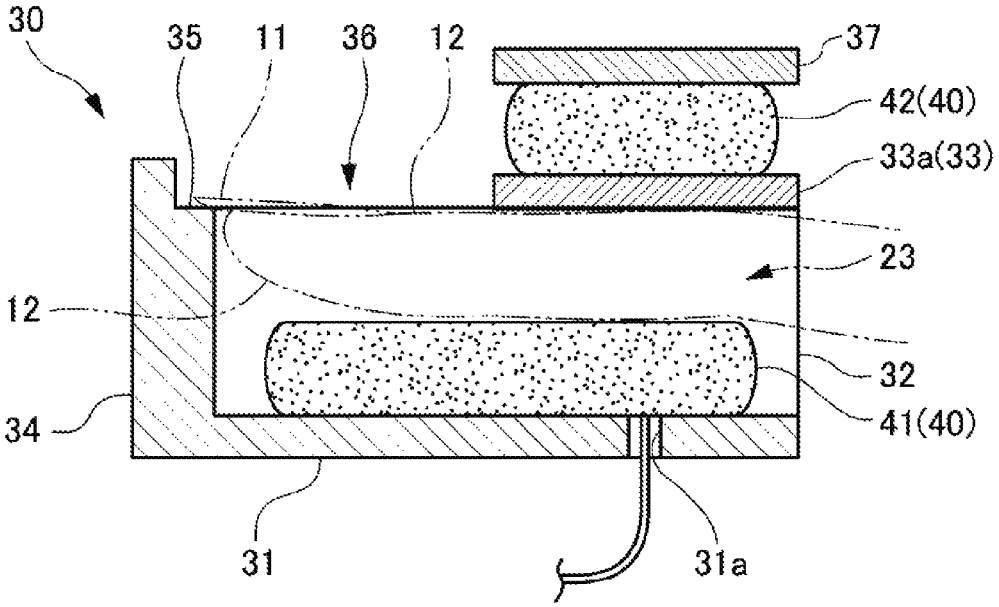

As illustrated in FIGS. 2A to 4B, a finger holding case 30 illustrated in FIGS. 2A to 2C and a finger presser 40 and a fluid supply/discharge unit 50 illustrated in FIGS. 3A and 3B are also arranged inside the case 20. The interior space of the finger holding case 30 provides a space for forming the finger insertion opening 23, and the finger presser 40 is arranged in this space.

The finger holding case 30 includes walls (a bottom wall 31, left and right sidewalls 32, a rear wall 34, and a top wall 33) that surround the finger insertion opening 23, and an opening 36 that exposes the nail 11. More specifically, as illustrated in FIGS. 3A and 3B, the finger holding case 30 includes the bottom wall 31, which has a through hole 31*a*. Moreover, as illustrated in FIGS. 2A to 2C, the finger holding case 30 includes: the left and right sidewalls 32 that extend upwards from the left and right edges of the bottom wall 31, respectively; the top wall 33 formed spanning across the top ends of the left and right sidewalls 32 on the front side in the finger insertion direction; the rear wall 34 that connects together the edges of the left and right sidewalls 32 on the rear side in the finger insertion direction; a nail rest 35 that is formed on the top edge of the rear wall 34 and that supports a nail tip 11*a* of the nail 11; and the opening 36 that is formed between the top wall 33 and the rear wall 34 and that exposes the top of the nail 11 of the inserted finger 12.

The upper wall 33 can be opened upwards, thereby expanding the space of the finger insertion opening 23 upwards. In the present embodiment, the top wall 33 includes left and right plates 33*a* and hinges 33*b* that are connected to the top ends of the left and right sidewalls 32 so as to make it possible for one of the ends of each of the left and right plates 33*a* to rotate freely upwards and downwards, for example. Allowing the left and right plates 33*a* to rotate upwards around the hinges 33*b* in this way makes it possible for the top wall 33 (the upper surface) of the finger insertion opening 23 to open upwards in a manner similar to double doors. Furthermore, springs 33*c* that energize the left and right plates 33*a* in the opening direction are connected between the other ends of the left and right plates 33*a* and the top ends of the left and right sidewalls 32. Alternatively, the hinges 33*b* may have built-in springs. Note that the orientation in which the left and right plates 33*a* cover the top of the finger insertion opening 23 horizontally is the lower limit of movement. The left and right plates 33*a* cannot rotate downwards past this orientation.

As illustrated in FIGS. 3A to 4B, the finger presser 40 is a bag-shaped member constituted by a sheet that is formed into a bag shape. The finger presser 40 includes a main finger presser 41 arranged on the bottom surface of the finger insertion opening 23, and a ring portion 42 that extends around the outside of the finger holding case 30 on the base side of the finger 12 relative to the nail 11 and that encircles the outer surface of the finger holding case 30 and is connected together above the finger holding case 30. Here, as illustrated in FIG. 2B, a notch 32*a* is formed in the bottom end sides of the sidewalls 32 of the finger holding case 30 to allow the ring portion 42 of the finger presser 40 to pass through.

As illustrated in FIG. 3A, a tube 51 is inserted into the through hole 31*a* from the outside and connected to the bottom side of the finger presser 40. The finger presser 40 inflates when a fluid is supplied to the interior thereof and deflates when the fluid is discharged from the interior. The fluid may be selected from various gases or liquids. For example, air is suitable for use as the fluid.

Figure 4A:
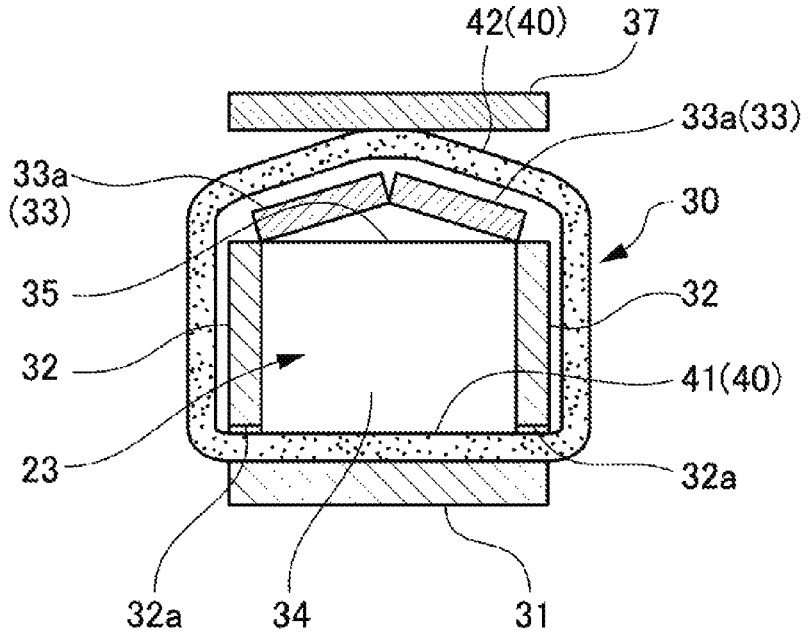
FIGS. 4A and 4B illustrate a cross section of the finger holding case and the surrounding areas according to the embodiment as taken along line B-B in FIG. 2A.
Figure 4B:
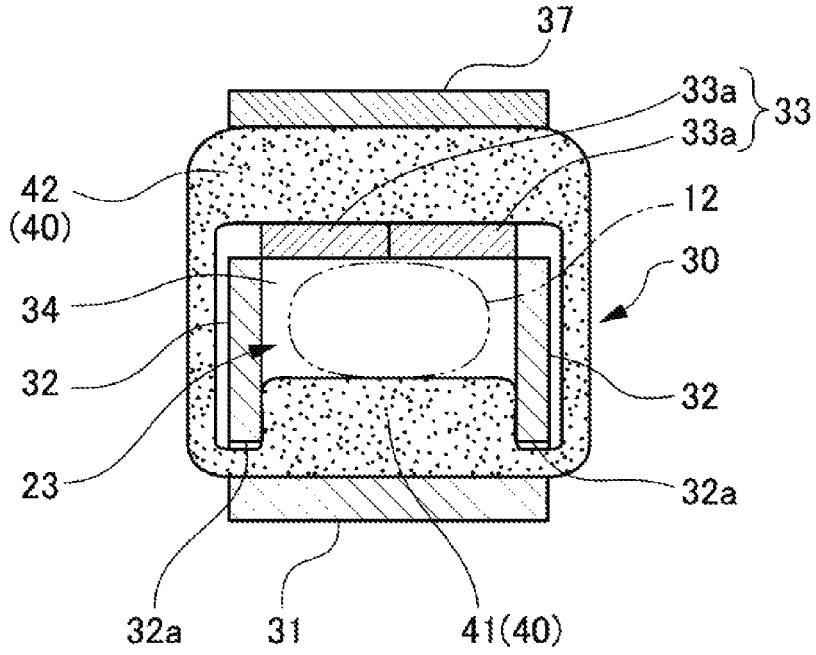

As illustrated in FIGS. 3A and 4A, when in a flat, deflated state, the main finger presser 41 allows the finger 12 to be inserted into and removed from the finger insertion opening 23. Meanwhile, as illustrated in FIGS. 3B and 4B, once inflated, the main finger presser 41 applies a pressing force to the bottom side of the finger 12 inserted into the finger insertion opening 23 to press the finger 12 upwards such that the portions of the top side of the finger 12 other than the nail 11 are pressed into the bottom surface of the top wall 33, thereby preventing movement of the finger 12. In this state, the nail 11 and the finger 12 are maintained in a substantially horizontal orientation with the nail tip 11*a* resting on the nail rest 35.

As illustrated in FIGS. 3A and 4A, in the deflated state, the ring portion 42 allows the top wall 33 to open upwards like double doors due to the energizing force of the springs 33*c*. This expands the space available above the finger insertion opening 23 when the finger 12 is inserted into or removed from the finger insertion opening 23. Meanwhile, as illustrated in FIGS. 3B and 4B, once inflated, the ring portion 42 opposes the energizing force of the springs 33*c* and presses the top wall 33 downwards, thereby keeping the top wall 33 in a closed horizontal state. This makes it possible for the top wall 33 to open upwards while also making it possible to press the finger 12 between the main finger presser 41 and the top wall 33 in order to prevent movement of the finger 12 during drawing.

As illustrated in FIGS. 3A to 4B, a plate-shaped restricting member 37 is formed above the top wall 33 with a prescribed gap left therebetween. The top of the ring portion 42 is arranged between the top wall 33 and the restricting member 37, with a section of the top of the ring portion 42 adhered to the bottom surface of the restricting member 37. This ensures that when in the deflated state illustrated in FIGS. 3A and 4A, the ring portion 42 is suspended away from the top wall 33 by the restricting member 37 such that the top wall 33 can still open upwards like double doors due to the energizing force of the springs 33*c*. This configuration also ensures that in the inflated state illustrated in FIGS. 3B and 4B, the ring portion 42 is restricted to expanding downwards by the restricting member 37, thereby increasing the downward pressing force applied to the top wall 33 and making it possible to reliably keep the top wall 33 closed.

The fluid supply/discharge unit 50 includes a pump 52 (such as an air pump) that is connected via the tube 51 to the finger presser 40 and that pumps a fluid to inflate the finger presser 40, a pressure sensor 53 for measuring the internal pressure of the finger presser 40, and a valve 54 (such as a solenoid valve) that is closed when the finger presser 40 is inflated and that is opened in order to discharge the fluid when the finger presser 40 is deflated.

(Operation of Embodiment)

Next, the operation of the drawing device 10 will be described with reference to FIGS. 3A to 5.

Figure 5:
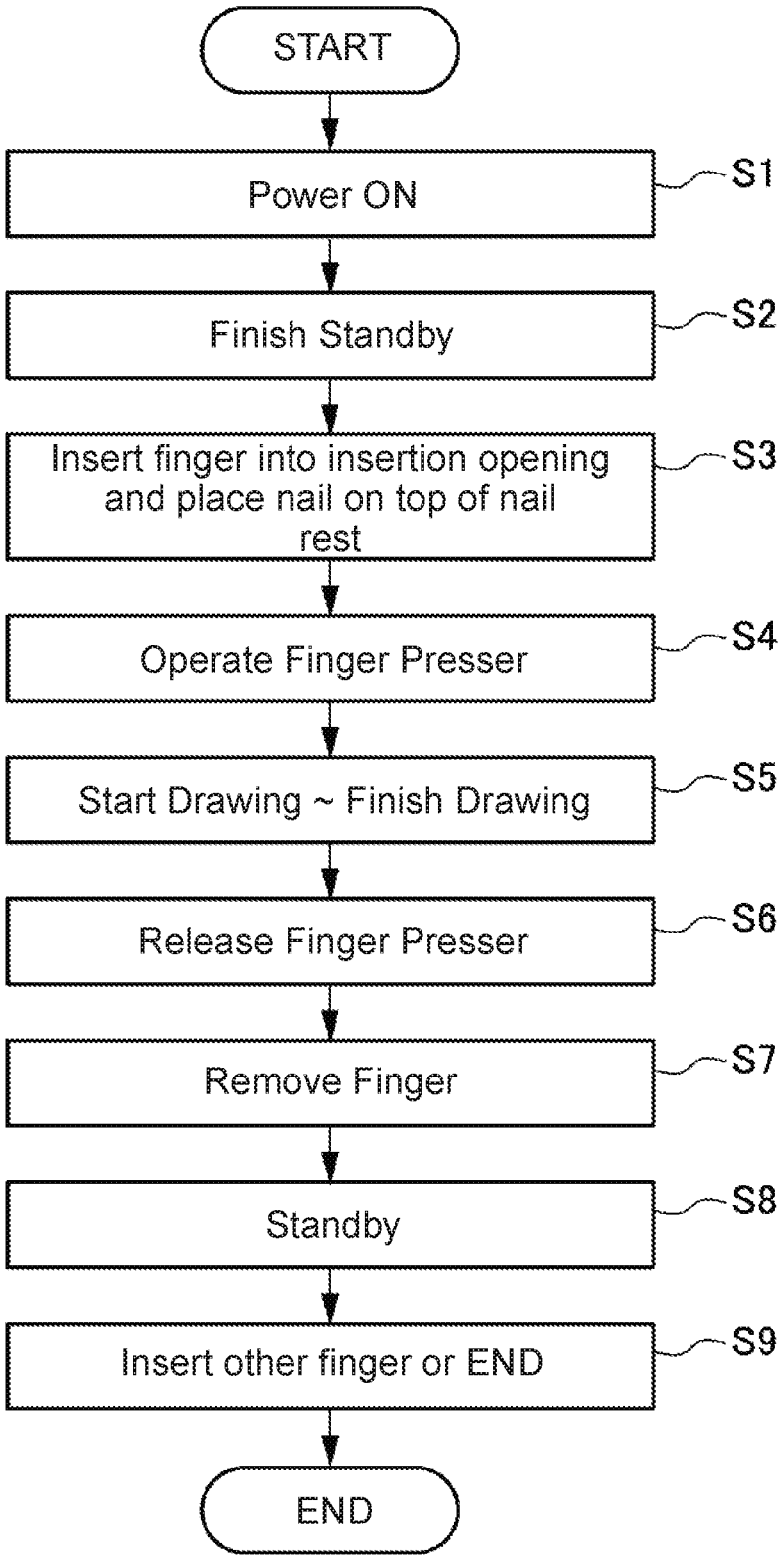
FIG. 5 is a flowchart illustrating an operational procedure of the drawing device according to the embodiment.

As illustrated in FIG. 5, first, in step S1, the drawing device 10 is powered on and performs a prescribed initial operation. Then, in step S2, the drawing device 10 enters a standby mode. Once the device is in this mode, in step S3, the user inserts the finger 12 that has the nail 11 to be drawn on into the finger insertion opening 23 and rests the nail tip 11*a* of the nail 11 on the nail rest 35. At this time, as illustrated in FIGS. 3A and 4A, the main finger presser 41 and the ring portion 42 of the finger presser 40 are deflated, and the top wall 33 is opened upwards like double doors. This expands the space above the finger insertion opening 23 and allows the finger 12 to be easily inserted into the finger insertion opening 23.

Once the finger 12 is inserted into the finger insertion opening 23 and the nail tip 11*a* has been rested on the nail rest 35, the device proceeds to step S4 and inflates the finger presser 40. To achieve this, the valve 54 is closed by supplying a current thereto, and then current is supplied to the pump 52, which begins to pump the fluid into the finger presser 40 via the tube 51 while the pressure sensor 53 measures the pressure, thereby pressurizing the interior of the finger presser 40. Once it is determined that the pressure measured by the pressure sensor 53 reaches a prescribed pressure that is set in advance, the pump 52 stops pumping the fluid.

In this way, as illustrated in FIGS. 3B and 4B, the main finger presser 41 of the finger presser 40 applies a pressing force to the bottom side of the finger 12 in order to press the finger 12 upwards such that the portions of the top side of the finger 12 other than the nail 11 are pressed into the bottom surface of the top wall 33, thereby preventing movement of the finger 12 relative to the finger holding case 30. In this state, the nail 11 and the finger 12 are maintained in a substantially horizontal orientation with the nail tip 11*a* resting on the nail rest 35. Moreover, the ring portion 42 opposes the energizing force of the springs 33*c* and presses the top wall 33 downwards, thereby keeping the top wall 33 in a closed horizontal state.

Next, in step S5, a nail design is drawn on the nail 11. Once drawing is complete, the device proceeds to step S6 and deflates the finger presser 40. This is achieved by cutting the supply of current to the valve 54 and discharging the fluid inside of the finger presser 40 via the valve 54 in order to deflate the finger presser 40. Once the main finger presser 41 of the finger presser 40 is deflated and returns to the original flat shape, pressure is no longer applied to the finger 12, which can then be removed from the finger insertion opening 23.

Moreover, once the ring portion 42 of the finger presser 40 is deflated, pressure is no longer applied to the top wall 33, thereby allowing the top wall 33 to open upwards like double doors due to the energizing force of the springs 33*c*. This expands the space above the finger insertion opening 23. Therefore, in step S7, when the finger 12 is removed from the finger insertion opening 23, the problem of the nail 11 coming into contact with the top wall 33 and damaging the nail design drawn on the nail 11 is solved. Once the finger 12 is removed from the finger insertion opening 23, the drawing device 10 proceeds to step S8 and returns to standby mode. Once in this mode, if another finger is inserted into the finger insertion opening 23, the device repeats steps S3 to S7. Otherwise, the device ends operation.

(Effects of Embodiment)

The present embodiment as described above makes it possible for a top surface portion (the top wall 33) of the finger insertion opening 23 to open, thereby expanding the space around the finger insertion opening 23 when movement of the finger 12 is not restricted by the finger presser 40. This makes it possible to reduce the possibility of the nail 11 coming into contact with the inner surfaces of the finger insertion opening 23 when the finger 12 is removed from the finger insertion opening 23 after drawing is complete.

Moreover, the top surface portion of the finger insertion opening 23 can open upwards like double doors, thereby making it possible to significantly expand the space above the finger insertion opening 23 near left and right intermediate portions that the nail 11 is particularly prone to contacting.

Furthermore, the finger presser 40 includes the main finger presser 41 arranged on the bottom wall 31 (a bottom surface portion) of the finger insertion opening 23 and the ring portion 42 that extends around the outside of the finger insertion opening 23 on the base side of the finger 12 relative to the nail 11 and that encircles the outer surfaces of the finger insertion opening 23 and is connected together above the finger insertion opening 23. Deflating the ring portion 42 removes the pressing force that presses the top surface portion of the finger insertion opening 23 into the closed state, thereby allowing the top surface portion of the finger insertion opening 23 to open upwards. This makes it possible to use the finger presser 40 to open and close the top surface portion of the finger insertion opening 23.

In addition, the drawing device 10 includes the restricting member 37, which is arranged sandwiching the ring portion 42 on a side opposite to the top surface portion of the finger insertion opening 23 and which restricts the inflation direction to facilitate inflation of the ring portion 42 towards the side that results in a pressing force being applied to the top surface portion of the finger insertion opening 23. This increases the pressing force applied to the top surface portion of the finger insertion opening 23, thereby making it possible to reliably keep the top surface portion of the finger insertion opening 23 closed.

Moreover, the finger holding case 30 includes the springs 33*c*, which energize the top surface portion of the finger insertion opening 23 in the opening direction. Therefore, when the finger presser 40 is deflated, the top surface portion of the finger insertion opening 23 can be reliably opened.

A preferred embodiment of the present invention was described in detail above. However, the present invention is not limited to the embodiment described above, and various changes and modifications may be made without departing from the spirit of the present invention as defined by the claims.

For example, the embodiment described above is configured to open the top surface portion (the top wall 33) of the finger insertion opening 23 when movement of the finger is not restricted by the finger presser 40. However, the configuration may be reversed in the vertical direction such that the ring portion 42 encircles around the outside of the bottom wall 31 side rather than the top wall 33 side so that bottom surface portion (the bottom wall 31) of the finger presser 23 opens. Therefore, any configuration in which the walls surrounding the finger insertion opening 23 (such as the top wall 33 (the top surface portion) or the bottom wall 31 (the bottom surface portion)) open outwards in order to expand the space between the finger holding case 30 and the finger 12 is possible.

Moreover, the embodiment described above is configured such that the top surface portion of the finger insertion opening 23 opens like double doors. However, opening/closing structures other than double doors may also be used. For example, opening/closing structures such as a single door or a sliding door may be used.

Furthermore, in the embodiment described above, the finger presser 40 is used to open and close the top surface portion of the finger insertion opening 23. Alternatively, however, a separate opening/closing mechanism (such as a motor, for example) may be used to open and close the top surface portion.

In addition, in the embodiment described above, the restricting member 37 is provided to facilitate inflation of the ring portion 42 in the downwards direction. However, the ring portion 42 inflates in a manner similar to a ring buoy, and therefore the inner side of the ring portion 42 inflates to a predetermined position. Therefore, the restricting member 37 does not necessarily need to be provided.

The present invention was described using the specific embodiment above as an example. However, the technical scope of the present invention is not limited to the embodiment described above. The scope of the present invention is not limited to the embodiment described above, and any configurations included in the scope of the claims and their equivalents are also encompassed by the present invention.

It is understood to persons skilled in the art that various modifications or improvements can be made to the specific embodiments described above, and such modifications and improvements are included within the technical scope of the present invention as defined by the claims.

What is claimed is:

1. A drawing device, comprising:

a holding case including a plurality of walls defining an insertion opening into which at least one finger or toe having a nail to be drawn on is inserted, the holding case having another opening that is configured to expose the nail when the at least one finger or toe is inserted into the holding case; and a presser that applies pressure to the finger or toe, which is inserted in the holding case, by receiving a fluid and that does not apply pressure to the finger or toe, which is inserted into the holding case, when said fluid is discharged from the presser, wherein the walls include a top surface portion on a side of said another opening of the holding case and a bottom surface portion facing the top surface portion, and wherein the walls are configured so that the top surface portion or the bottom surface portion opens outwards so as to expand a space between the holding case and the finger or toe when said fluid is discharged from the presser.

2. The drawing device according to claim 1, further comprising:

a drawing unit that draws on the nail to be drawn on exposed through said another opening of the holding case, wherein the drawing unit draws on the nail while the presser is applying pressure to the finger or toe.

3. The drawing device according to claim 1, wherein while the presser is applying pressure to the finger or toe, the top surface portion and the bottom surface portion remain in a closed state and do not move.

4. The drawing device according to claim 1, wherein the top surface portion or the bottom surface portion is movable in a double door manner.

5. The drawing device according to claim 1, wherein the top surface portion of the walls is adjacent to or next to said another opening of the holding case, wherein, when the top surface portion of the walls is configured to open outwards, the top surface portion has a lower limit of movement at a height corresponding to an upper boundary of the insertion opening of the holding case and is thereby restricted from moving further downwards beyond that lower limit, and wherein, when the bottom surface portion of the walls is configured to open outwards, the bottom surface portion has an upper limit of movement at a height corresponding to a lower boundary of the insertion opening of the holding case, and is thereby restricted from moving further upwards beyond that upper limit.

6. The drawing device according to claim 1, wherein the top surface portion of the walls is adjacent to or next to said another opening of the holding case, wherein the presser is a bag-shaped member that is inflatable by being filled with the fluid and is deflatable by discharging the fluid, wherein, when the top surface portion of the walls is configured to open outwards, the bag-shaped member includes:

a bottom portion on and above the bottom surface portion of the walls, configured to press the finger or toe from below when the bag-shaped member is filled with the fluid;

a top portion on and above the top surface portion of the walls, configured to press the top surface portion of the walls from above so as to close the top surface portion when the bag-shaped member is filled with the fluid; and a connecting portion that connects the bottom and top portions of the bag-shaped member so that pressure of the fluid is distributed in the bag-shaped member, and deflating the bag-shaped member by discharging the fluid removes a pressing force that presses and closes the top surface portion, thereby allowing the top surface portion to open outwards so as to expand said space between the holding case and the finger or toe, and wherein, when the bottom surface portion of the walls is configured to open outwards, the bag-shaped member includes:

a bottom portion on and below the bottom surface portion of the walls, configured to press the bottom surface portion of the walls from below so as to close the bottom surface portion when the bag-shaped member is filled with the fluid;

a top portion on and below the top surface portion of the walls, configured to press the finger or toe from above when the bag-shaped member is filled with the fluid; and a connecting portion that connects the bottom and top portions of the bag-shaped member so that pressure of the fluid is distributed in the bag-shaped member, and deflating the bag-shaped member by discharging the fluid removes a pressing force that presses and closes the bottom surface portion, thereby allowing the bottom surface portion to open outwards so as to expand said space between the holding case and the finger or toe.

7. The drawing device according to claim 6, further comprising:

a restricting member disposed adjacent to the top surface portion or the bottom surface portion of the walls that is configured to move outwards, the restricting member being positioned on a side of the bag-shaped member opposite to the top surface portion or the bottom surface portion that is configured to move outwards, thereby sandwiching the bag-shaped member with the top surface portion or the bottom surface portion of the walls and facilitating inflation of the bag-shaped member towards a side that applies pressure to the top surface portion or the bottom surface portion when inflated with the fluid.

8. The drawing device according to claim 6, wherein, when inflating the bag-shaped member, the fluid is supplied until an internal pressure of the bag-shaped member reaches a prescribed pressure that is set in advance.

9. The drawing device according to claim 1, wherein the top surface portion of the walls is adjacent to or next to said another opening of the holding case, wherein the top surface portion of the walls is openable, and wherein the holding case further includes a spring installed therein to energize the top surface portion of the walls in an opening direction.

10. The drawing device according to claim 1, wherein, when the presser is not applying pressure to the finger or toe, the space between the holding case and the finger or toe is greater than when the presser is applying pressure to the finger or toe.

11. A method of drawing for use in a drawing device that includes: a drawing unit that draws on a nail to be drawn on; a holding case including a plurality of walls defining an insertion opening into which at least one finger or toe having the nail to be drawn on is inserted, the holding case having another opening that is configured to expose the nail when the at least one finger or toe is inserted into the holding case; and a presser that applies pressure to the finger or toe by receiving a fluid and that does not apply pressure to the finger or toe when said fluid is discharged from the presser, wherein the walls include a top surface portion and a bottom surface portion facing the top surface portion, and wherein the walls are configured so that the top surface portion or the bottom surface portion moves outwards so as to expand a space between the holding case and the finger or toe, the method comprising:

discharging the fluid from the presser, thereby moving the top surface portion or the bottom surface portion outwards and expanding the space between the holding case and the finger or toe so as to facilitate insertion and removal of the finger or toe into or from the holding case of the drawing device through the insertion opening;

supplying the fluid to the presser, thereby applying the pressure to the finger or toe, which is inserted in the holding case, so as to fix the finger or toe at an inserted position in the holding case; and drawing on the nail using the drawing unit while the pressure is being applied to the finger or toe and the finger or toe is fixed at said inserted position.

12. The method according to claim 11, wherein while the presser is applying pressure to the finger or toe, the top surface portion and the bottom surface portion remain in a closed state and do not move.

13. The method according to claim 11, wherein the top surface portion or the bottom surface portion is movable in a double door manner.

14. The method according to claim 11, wherein the top surface portion of the walls is adjacent to or next to said another opening of the holding case, wherein, when the top surface portion of the walls is configured to open outwards, the top surface portion has a lower limit of movement at a height corresponding to an upper boundary of the insertion opening of the holding case and is thereby restricted from moving further downwards beyond that lower limit, and wherein, when the bottom surface portion of the walls is configured to open outwards, the bottom surface portion has an upper limit of movement at a height corresponding to a lower boundary of the insertion opening of the holding case, and is thereby restricted from moving further upwards beyond that upper limit.

15. The method according to claim 11, wherein the top surface portion of the walls is adjacent to or next to said another opening of the holding case, wherein the presser is a bag-shaped member that is inflatable by being filled with the fluid and is deflatable by discharging the fluid, wherein, when the top surface portion of the walls is configured to open outwards, the bag-shaped member includes:

a bottom portion on and above the bottom surface portion of the walls, configured to press the finger or toe from below when the bag-shaped member is filled with the fluid;

a top portion on and above the top surface portion of the walls, configured to press the top surface portion of the walls from above so as to close the top surface portion when the bag-shaped member is filled with the fluid; and a connecting portion that connects the bottom and top portions of the bag-shaped member so that pressure of the fluid is distributed in the bag-shaped member, and deflating the bag-shaped member by discharging the fluid removes a pressing force that presses and closes the top surface portion, thereby allowing the top surface portion to open outwards so as to expand said space between the holding case and the finger or toe, and wherein, when the bottom surface portion of the walls is configured to open outwards, the bag-shaped member includes:

a bottom portion on and below the bottom surface portion of the walls, configured to press the bottom surface portion of the walls from below so as to close the bottom surface portion when the bag-shaped member is filled with the fluid;

a top portion on and below the top surface portion of the walls, configured to press the finger or toe from above when the bag-shaped member is filled with the fluid; and a connecting portion that connects the bottom and top portions of the bag-shaped member so that pressure of the fluid is distributed in the bag-shaped member, and deflating the bag-shaped member by discharging the fluid removes a pressing force that presses and closes the bottom surface portion, thereby allowing the bottom surface portion to open outwards so as to expand said space between the holding case and the finger or toe.

16. The method according to claim 15, wherein the drawing device used in the method further comprises a restricting member disposed adjacent to the top surface portion or the bottom surface portion of the walls that is configured to move outwards, the restricting member being positioned on a side of the bag-shaped member opposite to the top surface portion or the bottom surface portion that is configured to move outwards, thereby sandwiching the bag-shaped member with the top surface portion or the bottom surface portion of the walls and facilitating inflation of the bag-shaped member towards a side that applies pressure to the top surface portion or the bottom surface portion when inflated with the fluid.

17. The method according to claim 15, wherein, when inflating the bag-shaped member, the fluid is supplied until an internal pressure of the bag-shaped member reaches a prescribed pressure that is set in advance.

18. The method according to claim 11, wherein the top surface portion of the walls is adjacent to or next to said another opening of the holding case, wherein the top surface portion of the walls is openable, and wherein the holding case further includes a spring installed therein to energize the top surface portion of the walls in an opening direction.

* * * * *